US005595326A

United States Patent [19]

Bougamont et al.

[11] Patent Number: 5,595,326

[45] Date of Patent: Jan. 21, 1997

[54] SYSTEM FOR PACKAGING AND DISPENSING A LIQUID PRODUCT

[75] Inventors: Jean-Louis Bougamont, Eu; Stanislas Peronnet, Paris, both of France

[73] Assignee: Sofab, LeTreport, France

[21] Appl. No.: 368,996

[22] Filed: Jan. 5, 1995

[30] Foreign Application Priority Data

Jan. 7, 1994 [FR] France ..... 94 00109

[51] Int. Cl.[6] ..... B67D 5/54

[52] U.S. Cl. ..... 222/321.7; 222/162; 222/321.9

[58] Field of Search ..... 222/80, 81, 82, 222/321.1, 321.2, 321.7, 321.9, 382, 162, 183, 385

[56] References Cited

U.S. PATENT DOCUMENTS

| | | | |
|---|---|---|---|
| 3,120,328 | 2/1964 | Corsette et al. | 222/382 X |
| 3,120,906 | 2/1964 | Harnage | 222/321.9 |
| 4,122,982 | 10/1978 | Giuffredi | 222/321.2 |
| 4,361,253 | 11/1982 | Flynn et al. | 222/464.1 X |
| 4,526,302 | 7/1985 | Brunet | 222/321.7 |
| 4,779,763 | 10/1988 | Klawitter | 222/80 |

FOREIGN PATENT DOCUMENTS

| | | |
|---|---|---|
| 792 | 3/1903 | France . |
| 2382946 | 10/1978 | France . |
| 2502721 | 10/1982 | France . |
| 0065432 | 11/1982 | WIPO . |
| 0143183 | 6/1985 | WIPO . |

*Primary Examiner*—Kevin P. Shaver
*Attorney, Agent, or Firm*—Fish & Richardson P.C.

[57] ABSTRACT

A system for packaging and dispensing liquid includes a glass vial, a metering pump and an assembly element. The vial, which defines a volume for receiving and containing the liquid, has a body, neck and tip. The neck and tip are joined at a line of weakness, and the vial is opened by snap-off removal of the tip at the weakness. The metering pump has a tubular body with a dip tube projecting downward, and a push-button dispensing head with a piston disposed for movement within the pump body, with a hollow rod defining an ejection duct projecting upwards. The pump body defines a vent closed by the piston at rest, and, in a mid-region, defines a shoulder for supporting engagement upon a lip of the vial neck. The assembly element, disposed for sealing engagement between the pump and vial, includes an elastically deformable sleeve fixed in sealed engagement upon a top portion of the pump body by a waist-band, with a skirt extending from the waist-band into sealing engagement against an exterior wall surface of the vial.

13 Claims, 8 Drawing Sheets

SYSTEM FOR PACKAGING AND DISPENSING A LIQUID PRODUCT

The present invention relates to a system for packaging and dispensing a liquid product.

BACKGROUND OF THE INVENTION

To avoid any degradation or contamination, certain products, and in particular pharmaceutical products liable to deterioration, are packaged in sterile packs such as glass vials suitable for being opened at the neck by breaking a snap-off tip.

Even though they can be conserved or used only for relatively short periods of time once they have been opened, such products may nevertheless be designed to be dispensed directly from the vials in the form of successive doses.

Unfortunately, an opened vial is fragile, and above its shoulder, its neck possesses a lip that has a sharp edge of irregular outline.

In known systems, the newly-opened glass vial is inserted into the bottom of a case having a top that carries a pump which is provided with a spray head. The case, which is fairly rigid and which is secured to the pump, includes a rod that bears against the bottom of the vial to hold it inside and to keep its shoulder pressed against the top portion of the case.

However, it remains difficult to ensure good mechanical strength and satisfactory sealing, thereby compromising the sterility and qualities of the packaged product.

SUMMARY OF THE INVENTION

An object of the present invention is to solve these technical problems in satisfactory manner.

This object is achieved with a system for packaging and dispensing a liquid product, the system including firstly a glass vial in which the product is enclosed, the vial being suitable for being opened at its neck by breaking a snap-off tip, and secondly an ordinary miniature metering pump provided with a tubular body carrying a dip tube and containing a piston having a hollow rod that serves as an ejection duct and that projects in the opposite direction to the dip tube, the pump also possessing a vent which is closed by the piston when in its rest position; the system further including an assembly element for sealed assembly of the pump on the vial, and a dispensing head that serves as a push-button. According to the invention the assembly element is constituted by an elastically deformable sleeve permanently fixed in sealed manner on the top portion of the pump body by a top waist-band and suitable for clamping against the wall of the neck of the vial in sealed manner via a bottom skirt; and the middle portion of the pump and sleeve assembly has a shoulder that then bears (directly or indirectly) against the lip of the neck.

Advantageously, prior to assembly, the inside diameter of the waist-band forming the top portion of the sleeve is smaller than the diameter of the top portion of the pump body, and is designed to be mounted in abutment thereon as an interference fit.

Preferably, the bottom portion of the pump body has a diameter that is smaller than the diameter of the mouth of the neck of the vial so as to enable it to be inserted therein.

In a variant, the vial includes a bulb forming the neck, beneath the line of weakness of the snap-off tip.

The invention provides for the skirt, on assembly, to be able to accommodate radial extension lying in the range 10% to 25%, and for the coefficient of friction of the sleeve on glass to be at least 0.20.

According to an advantageous characteristic, the inside face of the skirt, at least in its bottom portion in contact with the vial, includes peripheral ribs that form radial clamping bearing surfaces.

In another variant, and in particular when all of the pump is of a diameter that is smaller than the diameter of the neck of the vial, the sleeve forms a first shoulder at the beginning of its waist-band, thereby defining a central well for holding the pump in sealed manner, there being a second shoulder at the beginning of the skirt, which second shoulder is placed over the lip of the open vial.

Advantageously, the sleeve includes an inside ring which projects from said shoulders towards the inside of the vial, and which clamps in sealed manner against at least a part of the pump body.

In another variant, the sleeve is in the shape of a glove finger having an end through which the nozzle of the pump passes.

In yet another variant, the dispenser head whose top portion is designed to cover the nozzle of the pump for the purpose of driving it, extends downwards in the form of a cylindrical wall that descends below the bottom of the vial so as to form a stable support. Advantageously, the wall constitutes a sheath suitable for guiding the vial.

The system of the invention makes it simple to achieve effective coupling between a sterile glass vial and a miniature metering pump.

The invention thus makes it possible to dispense spoilable liquid products in repeated manner over a relatively short period of time from a glass vial while maintaining thorough sealing while the system is at rest.

BRIEF DESCRIPTION OF THE DRAWINGS

The invention will be better understood on reading the following description given with reference to the accompanying drawings, in which.

DETAILED DESCRIPTION OF THE INVENTION

Figure 2:
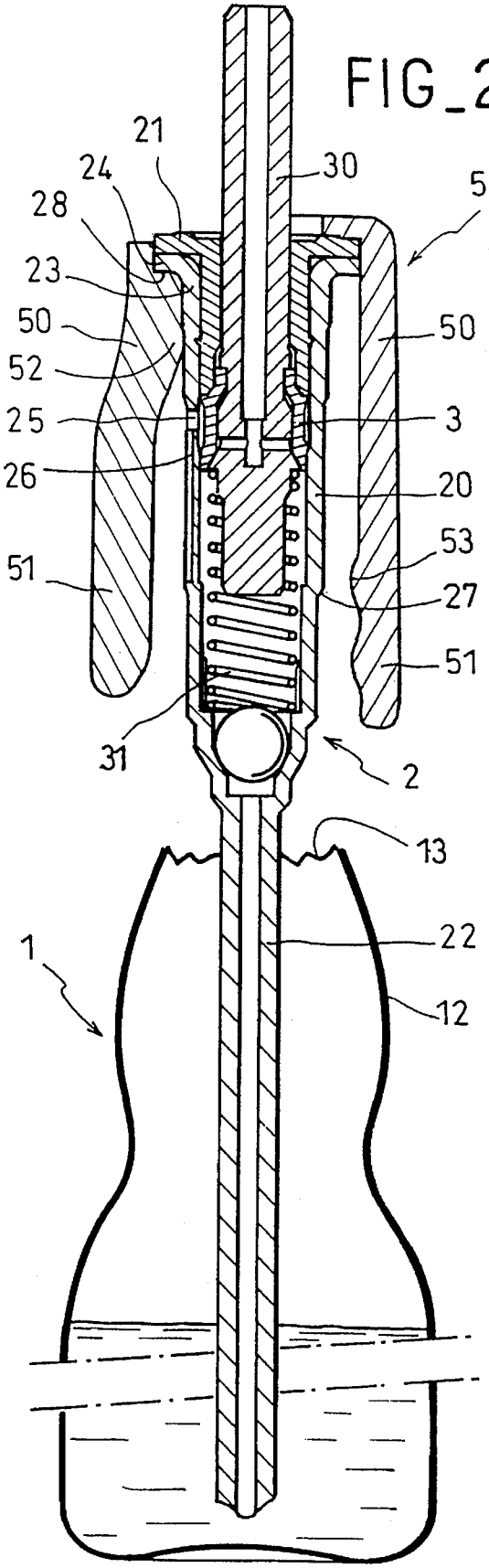
FIG. 2 comprise two exploded half-sections corresponding to two variants of a first embodiment of the invention.
Figure 2A:
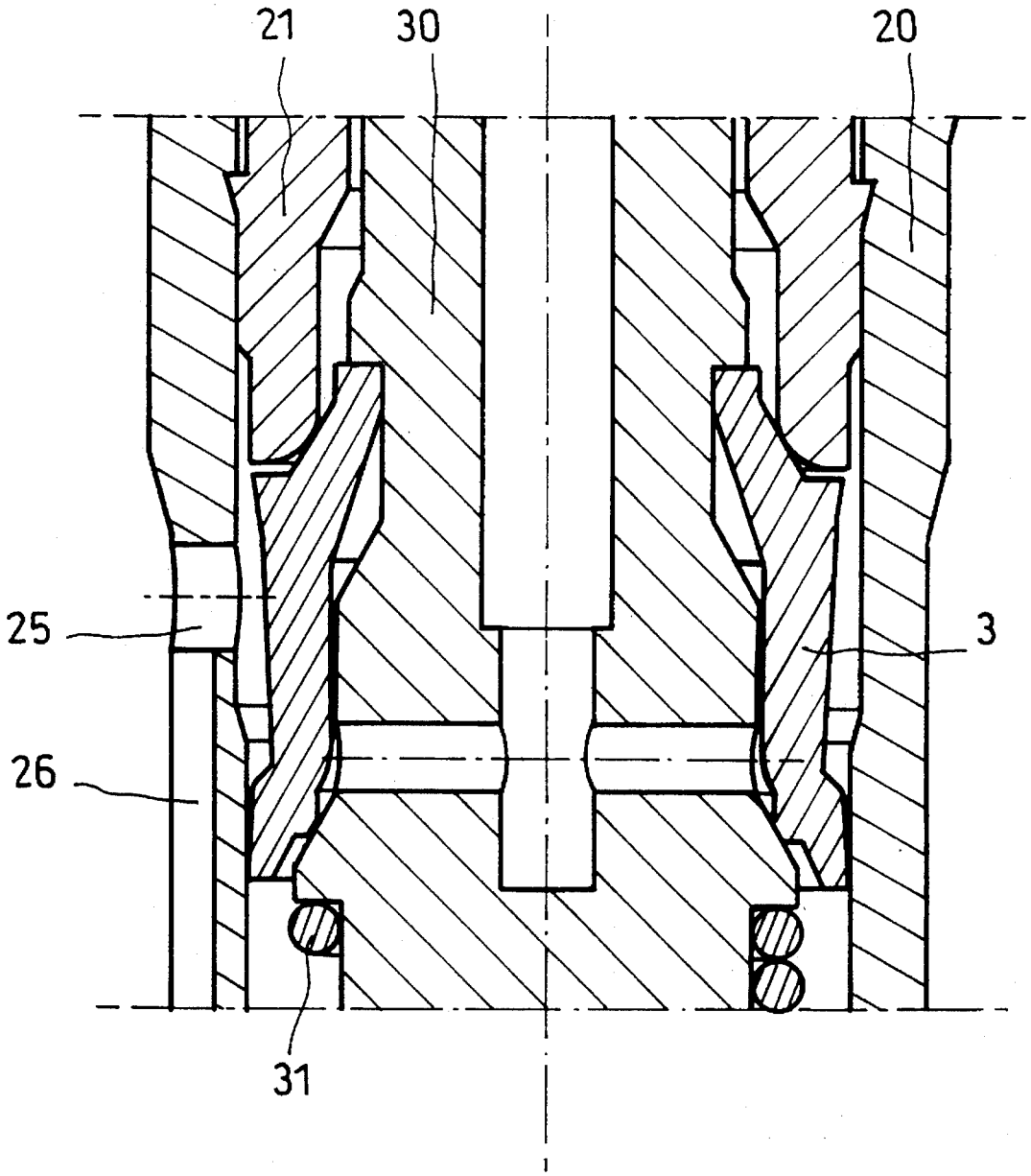
FIG. 2*a* is a detail section view of the pump shown in FIG. 2.

In all of the figures, the pump used remains the same as that shown in section in FIGS. 2 and 2*a*.

Figure 1:
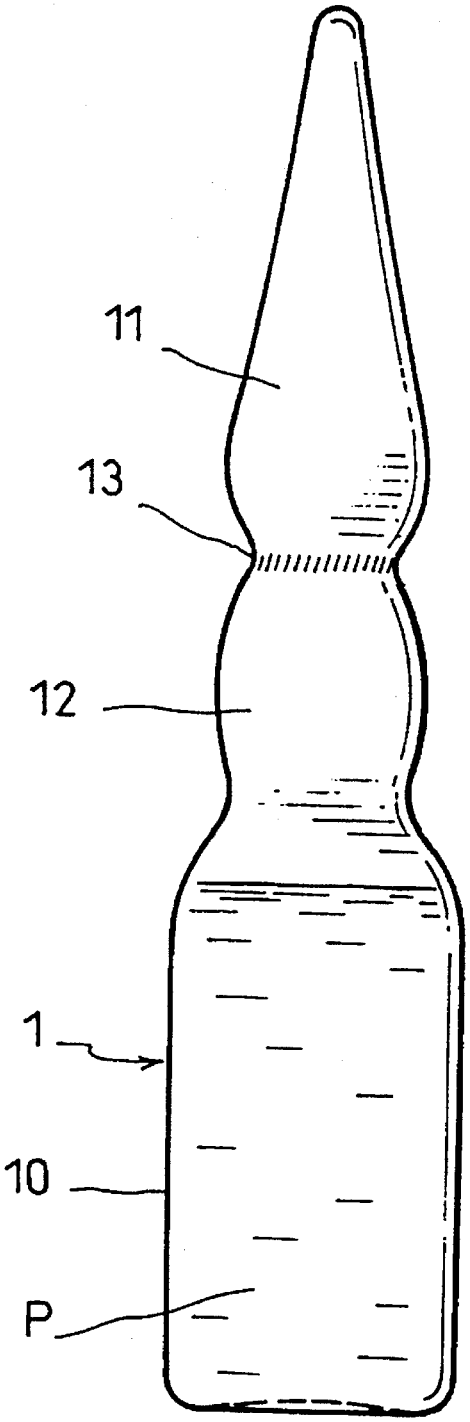
FIG. 1 is an elevation view of a vial as one of the component parts of a system of the invention.

The vial 1 shown in FIG. 1 comprises a cylindrical bottom portion or cylinder 10 having a bottom that is substantially flat.

The liquid product P is normally enclosed in the sterile vial, being contained in the cylindrical bottom portion thereof 10.

The vial has a tip 11 which in this case is in the form of a tapering bulb surmounting a second bulb 12, and there is an annular line of weakness 13 between the tip 11 and the bulb 12. The bulb 12 constitutes the neck of the open vial after the snap-off tip 11 has been removed, and the line 13 gives rise to an edge on the lip of the neck.

Figure 3:
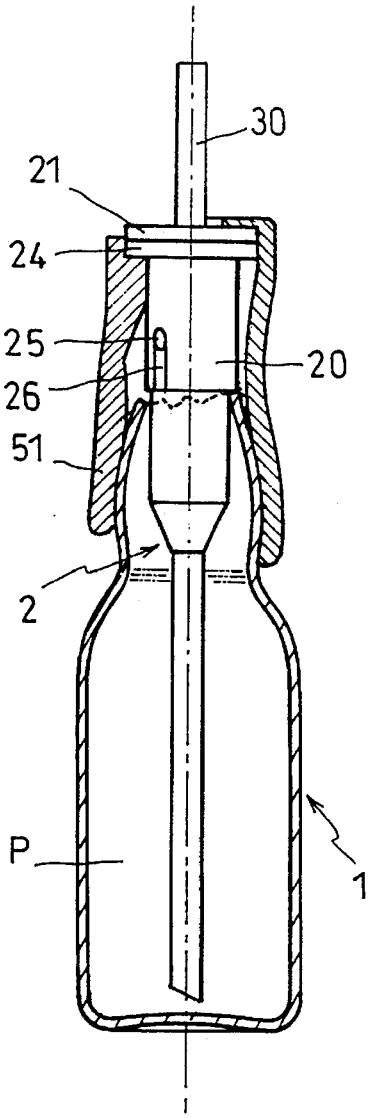
FIG. 3 comprises two half-sections of the variant embodiments of FIG. 2 when in the assembled condition.

As shown in FIGS. 2 and 3, the system of the invention includes a glass vial 1 of the type shown in FIG. 1, after it has been opened by removing the snap-off tip 11 at the line of weakness 13.

A miniature metering pump is then installed on the vial which is shown diagrammatically. As shown in section in FIG. 2, the pump includes firstly a two-part assembly 2 enclosing its piston 3, i.e. a cylindrical housing 20 that receives the piston, and a closure cup or collar 21 assembled thereon. For simplicity, this assembly is referred to below as the "body" 2 (even though this term is commonly preferably applied to the main part 20 thereof).

At its bottom, the housing 20 carries a dip tube 22. The collar 21 is engaged inside the housing 20 and comes flush only with the rim 23 to create a flange 24. The vertical hollow rod or nozzle 30 of the piston 3 projects upwards through the central opening of the collar, thereby serving as an ejection duct, and enabling the pump to actuated to cause a dose of product P to be emitted from the dispenser head 4. A vent 25 then opens to the inside of the vial via a groove 26 for the purpose of providing a connection to atmospheric air, and while it is at rest, the piston 3 under drive from a return spring 31 closes the vent 25.

The system of the invention also includes a sleeve 5 for providing sealed connection between the pump 2 and the vial 1. It comprises a top waist-band 50 that is extended by a skirt 51 suitable for fitting over the neck of the bulb 12 of the vial. The sleeve 5 is resiliently deformable, and it is assembled on manufacture by means of its waist-band 50 which is engaged in sealed manner to the top of the body 2. In use, the lower skirt 51 fits closely over the neck 12 of the bulb to provide sealed radial clamping; via its shoulder 27, the pump rests against the lip 13 of the vial 1 but does not establish sealed connection therewith.

The height of the sleeve is a little less than the height between the top face of the pump body 2 and the bottom end of the neck or bulb 12.

In the variant in the left-hand half of FIGS. 2 and 3, the waist-band 50 is mainly clamped around the flange 24; it is thick enough, at least at the top, to form a stiffening ring 52 that reinforces the assembly.

Advantageously, as shown in the right-hand half of FIGS. 2 and 3, the sleeve 5 may be in the form of a glove finger having the nozzle 30 of the pump 2 passing therethrough. Under such circumstances, the sleeve assembles the parts together by completely encompassing the flange 24, including both the side face and the top face of the collar 21.

At least in its bottom portion that comes into contact with the neck 12 of the vial, the inside face of the skirt 51 includes peripheral ribs 53 that form bearing surfaces in radial clamping.

The sleeve 5 is preferably made of an elastomer material capable of accommodating radial extension of up to 50% so as to enable the sleeve to deform elastically around the neck or bulb 12 while producing radial clamping that guarantees sealing for the assembly.

To prevent any slipping of the sleeve 5, provision is made for its inside surface to have a coefficient of friction on glass of at least 0.20.

The differences in thickness and in diameter between the waist-band 50 and the skirt 51 are chosen so as to ensure appropriate rigidity at all points in the assembly.

Figure 4:
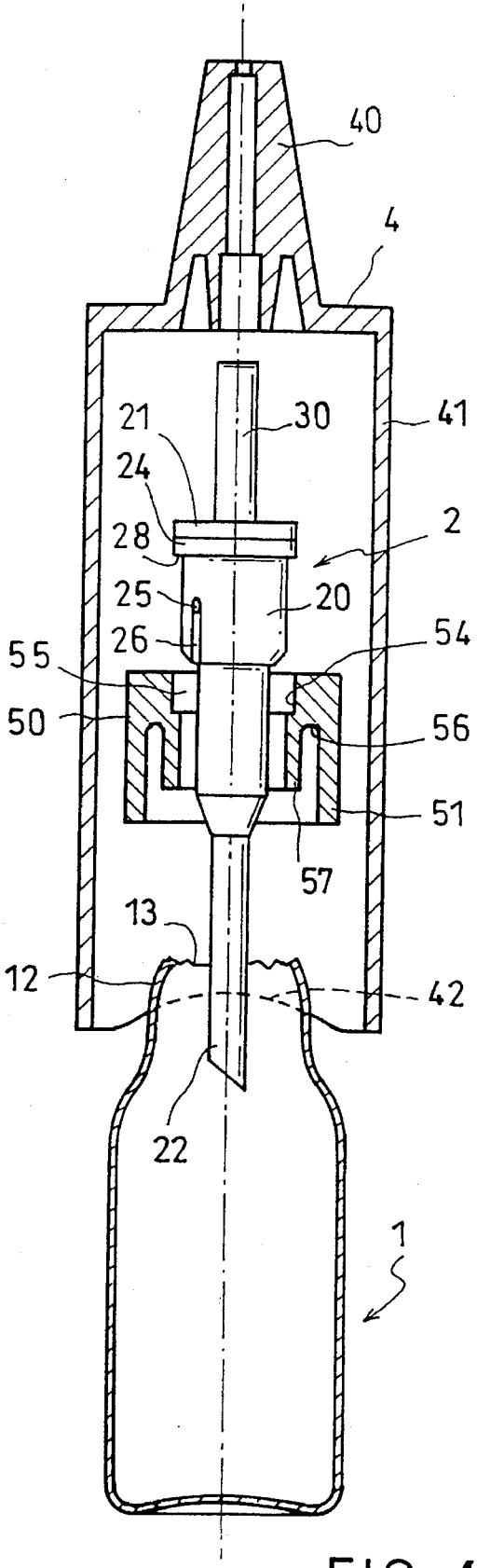
FIG. 4 is an exploded section through a second embodiment of the invention.
Figure 5:
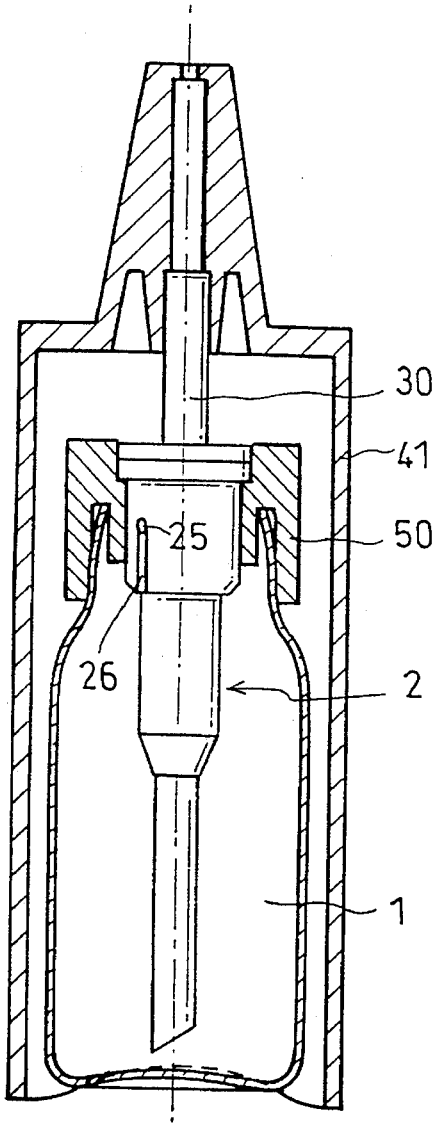
FIG. 5 is a section through the FIG. 4 embodiment in the assembled condition.

FIGS. 4 and 5 show another embodiment of the system of the invention in which the vial has a wider neck.

The shoulder 28 of the flange 24 now serves as an indirect support point for the pump.

For this purpose, the waist-band 50 is provided with a shoulder 54 defining a central well 55 for the flange 24, and enabling it to be held in sealed manner.

Similarly, the skirt 51 has a shoulder 56 that is placed over the edge of the lip 13 of the vial 1. An inside ring 57 projects axially from the shoulders 54 and 56 towards the inside of the vial 1. It serves to clamp against at least a part of the pump body 2, protecting the inside of the neck 12 of the vial, while not masking the vent 25.

In this way, the shoulder 28 bears against the lip 13 only indirectly. This increases the range of diameters that can be accommodated, and distributes pressure forces better.

The system shown also includes a pusher and dispensing head 4 whose top portion 40 is designed to fit over the nozzle 30 of the pump 2 to form a spray head. Its top portion 40 is extended downwards by a cylindrical wall 41 whose bottom edge comes below the bottom of the vial 1, so as to constitute a sheath that provides stable support.

The bottom edge of the wall 41 may optionally include cutouts 42 making it easier to press against the bottom of the vial 1.

FIGS. 6 to 9 show yet another embodiment of the invention, in which the diameter of the waist-band 50 is smaller than or equal to the diameter of the skirt 51, thereby defining a sloping shoulder 58 where they join together. This shoulder does not bear directly against the edge of the lip 13, but bears against the conical rim of the neck 12 in the vicinity of the edge.

The waist-band 50 is engaged in sealed manner on the tip ferrule of the housing 20 beneath the flange 24 and in abutment against the shoulder 28.

The skirt 51 of the sleeve 5 for fitting over the neck 12 of the vial, terminates in a flared edge 59 in order to facilitate assembly.

Figure 6:
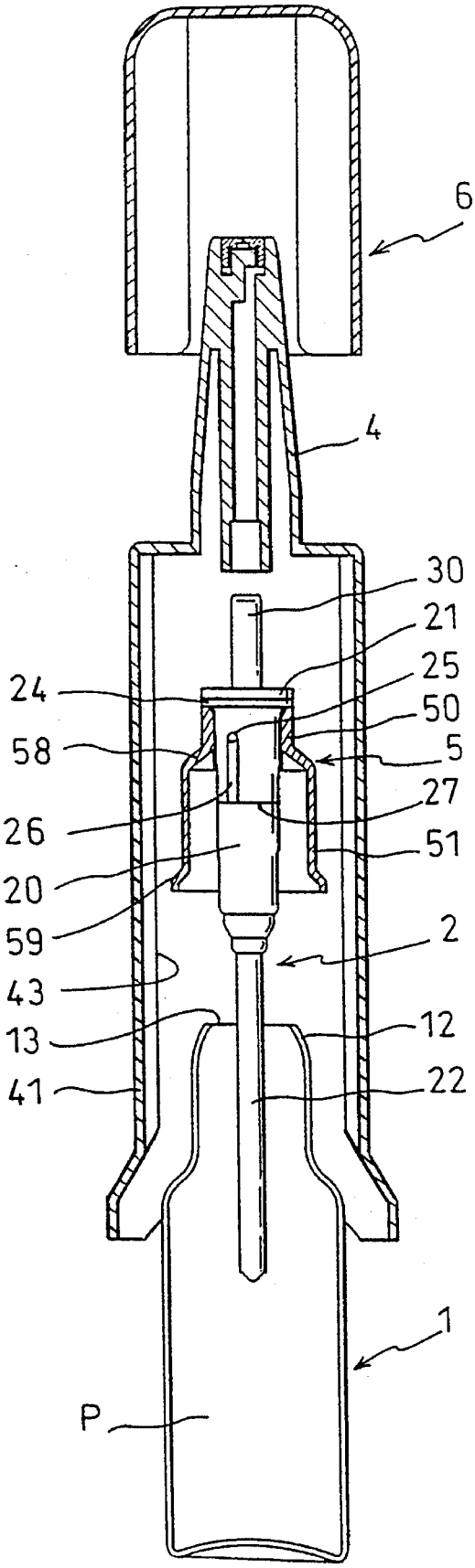
FIGS. 6, 7, 8, and 9 are sections through a third embodiment shown respectively: before assembly (FIG. 6); in an intermediate position during assembly (FIG. 7); at rest when assembled (FIG. 8); and in action (FIG. 9).

FIG. 6 shows the vial being inserted into the cylindrical wall 41 through its bottom, with the dip tube 22 being immersed in the liquid P.

In a variant the sleeve 5 could be delivered with its skirt 51 turned up.

Figure 7:
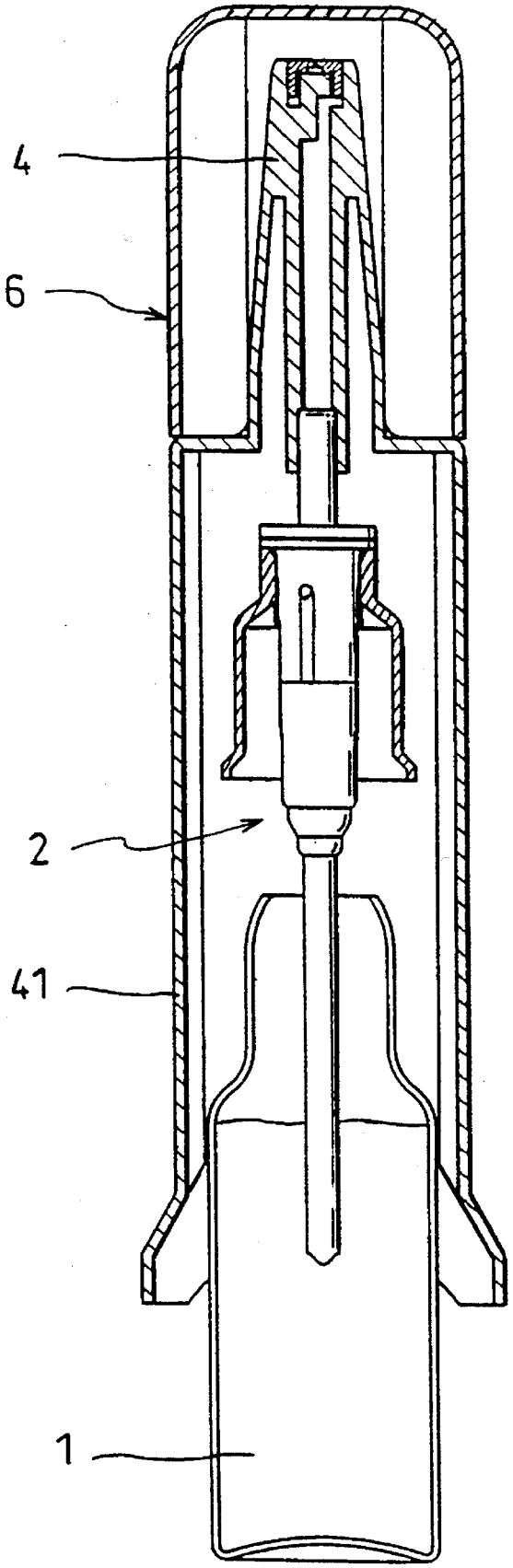

FIG. 7 shows the system with the neck 12 of the vial at the entrance to the sleeve 5. The head 4 receives a cover 6. Final installation is then performed by pressing vertically against the bottom of the vial 1 which is guided accurately by the ribs 43 carried by the wall 41 until the neck 12 comes into abutment inside the sleeve 5 where the sleeve 5, the collar 21, and the pump 2 are all assembled together.

Figure 8:
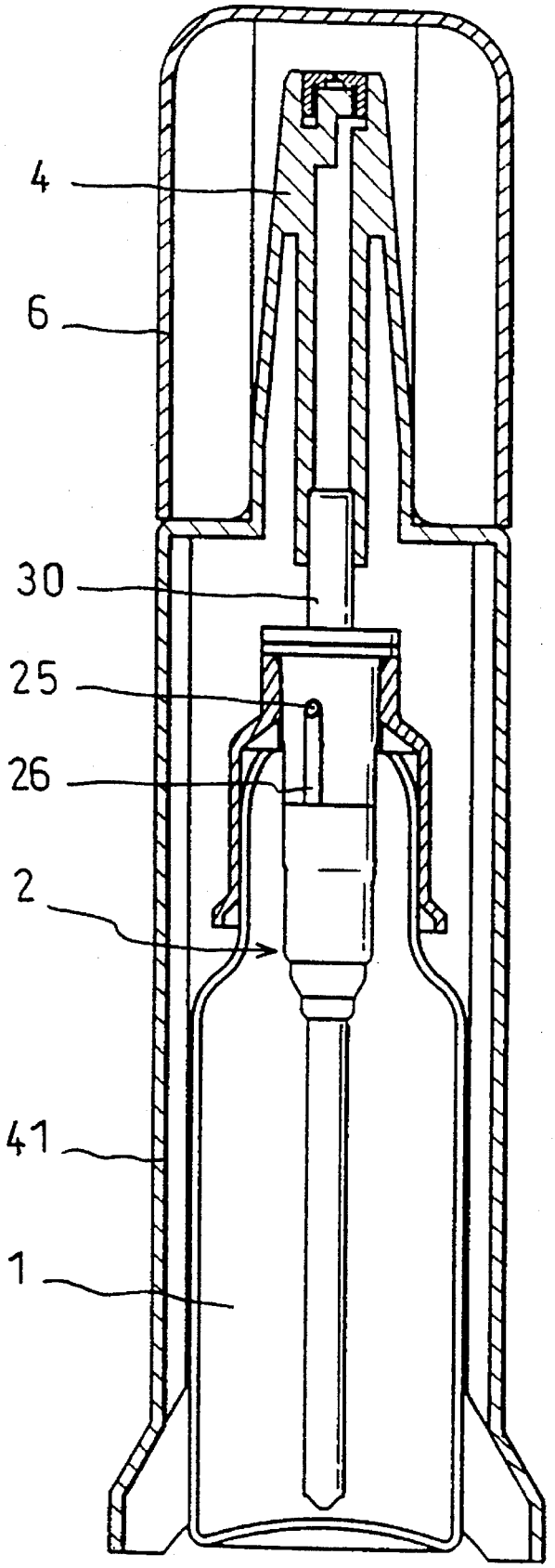

FIG. 8 shows the assembled system, at rest, and sealed.

Figure 9:
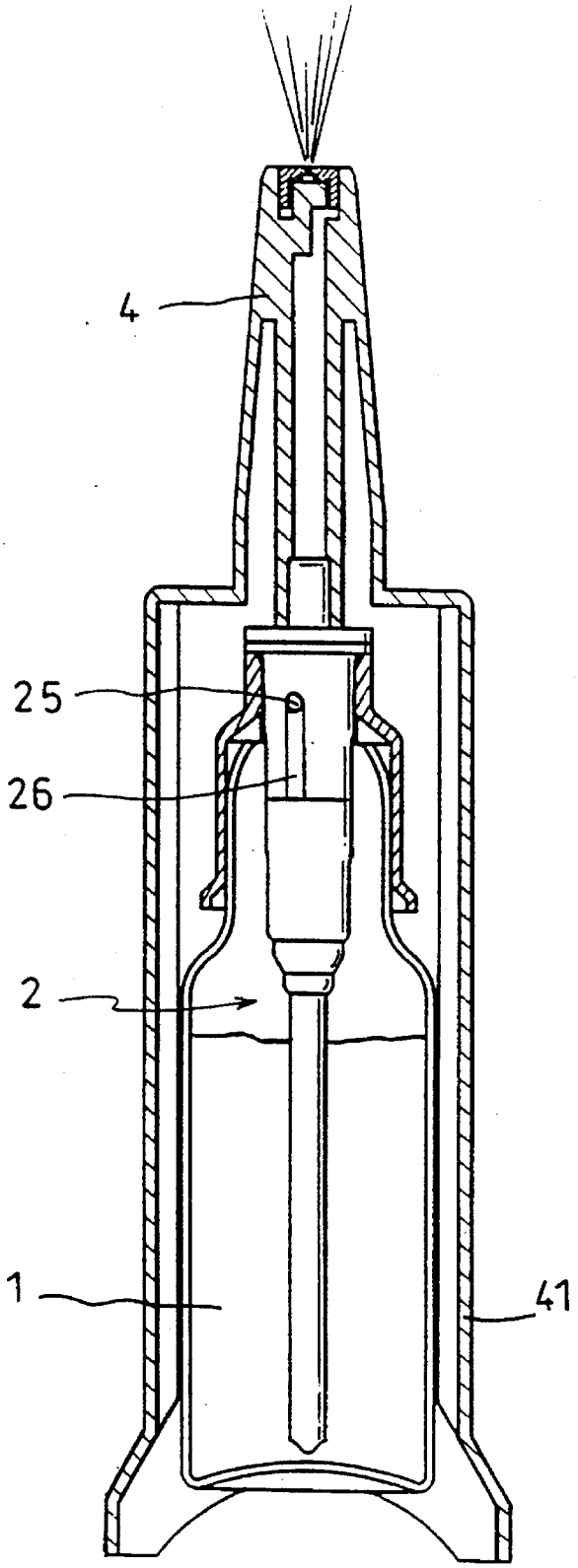

FIG. 9 shows the system in operation, with pressure being applied between the bottom of the vial 1 and the head 4, to move them beyond the rest position. The vertical thrust actuates the pump 2 and causes a dose of product to be ejected through the nozzle in the head 4. The vent 25 enables pressure inside the vial to be brought back into equilibrium, but the vent path to the atmosphere remains open for a short time only, so the state of the remaining product is not compromised.

We claim:

1. A system for packaging and dispensing a liquid product, the system comprising:

a glass vial defining a volume for receiving and containing the liquid product, said glass vial comprising a body portion, a neck portion, and a tip portion, said neck portion and said tip portion joined together at a line of weakness, said glass vial adapted to be opened by snap-off removal of said tip portion from said neck portion at said line of weakness;

a metering pump comprising:

a tubular pump body with a dip tube projecting axially in a first direction, and a push-button dispensing head comprising a piston disposed for axial movement within said pump body, with a hollow rod defining an ejection duct projecting axially in a second direction opposite to said first direction of said dip tube, said pump body defining a vent closed by said piston in a rest position; and said pump body, in a mid-region, defining a shoulder disposed for supporting engagement upon a lip of said neck portion of said glass vial; and an assembly element disposed for sealing engagement between said pump body and said glass vial, said assembly element comprising an elastically deformable sleeve permanently fixed in sealed engagement upon a top portion of said pump body by a top waist-band, with a skirt extending from said top waist-band and disposed for sealing engagement against an exterior wall surface of said neck portion of said glass vial.

2. A system according to claim 1, wherein said pump body, in a bottom portion extending below said shoulder, has a diameter smaller than a corresponding diameter of a mouth aperture defined by said lip of said neck portion of said glass vial.

3. A system according to claim 1, wherein, prior to assembly, said top waist-band of said sleeve has an inside diameter smaller than a corresponding outside diameter of said top portion of said pump body, whereby, upon assembly, said top waist-band is mounted in abutment upon said top portion of said pump body with interference fit.

4. A system according to claim 1, wherein said glass vial comprises a bulb forming said neck portion, beneath said line of weakness of said tip portion.

5. A system according to claim 1, wherein, on assembly, said skirt, in a lower edge region, has an inner diameter adapted for radial expansion of 10% to 25%, and said sleeve has a coefficient of friction on said exterior wall surface of said neck portion of said glass vial of at least 0.20.

6. A system according to claim 1, wherein an inside face surface of said skirt, at least in a lower edge region disposed for contact with said exterior wall surface of said neck portion of said glass vial, defines peripheral ribs that form radial clamping bearing surfaces.

7. A system according to claim 1, wherein said sleeve comprises a glove finger having an end through which said hollow rod defining said ejection duct of said pump passes.

8. A system according to claim 1, wherein said dispensing head further comprises a top portion adapted to be placed over said ejection duct of said pump to drive said pump, and a cylindrical wall extending beneath said glass vial to form a sheath and provide stable support for said glass vial.

9. A system according to claim 7, wherein said top waist-band of said sleeve has an outside diameter and said skirt has an outside diameter, the outside diameter of said top waist-band being smaller than or equal to the outside diameter of said skirt.

10. The system according to claim 1, wherein said pump body bears in direct supporting relationship upon said lip of said neck portion.

11. The system according to claim 7, wherein said pump body bears in indirect supporting relationship upon said lip of said neck portion.

12. A system for packaging and dispensing a liquid product, the system comprising:

a glass vial defining a volume for receiving and containing the liquid product, said glass vial comprising a body portion, a neck portion, and a tip portion, said neck portion and said tip portion joined together at a line of weakness, said glass vial adapted to be opened by snap-off removal of said tip portion from said neck portion at said line of weakness;

a metering pump comprising:

a tubular pump body with a dip tube projecting axially in a first direction, and a push-button dispensing head comprising a piston disposed for axial movement within said pump body, with a hollow rod defining an ejection duct projecting axially in a second direction opposite to said first direction of said dip tube, and said pump body defining a vent closed by said piston in a rest position; and an assembly element disposed for sealing engagement between said pump body and said glass vial, said assembly element comprising an elastically deformable sleeve permanently fixed in sealed engagement upon a top portion of said pump body by a top waist-band, with a skirt extending from said top waist-band and disposed for sealing engagement against an exterior wall surface of said neck portion of said glass vial, wherein said pump body has a diameter smaller than a corresponding diameter of a mouth aperture defined by a lip of said neck portion of said glass vial, and wherein said sleeve, in a region of said top waist-band, has a first sleeve shoulder defining a central well for holding said pump body in sealed manner, and said sleeve, in an upper region of said skirt, has a second sleeve shoulder adapted to be placed over said lip of said glass vial.

13. A system according to claim 12, wherein said sleeve defines an inside ring projecting from a region of said first and second sleeve shoulders inwardly towards said glass vial to clamp in sealed manner against said pump body.

* * * * *